US009119474B2

(12) United States Patent
Husslage et al.

(10) Patent No.: US 9,119,474 B2
(45) Date of Patent: Sep. 1, 2015

(54) HEIGHT ADJUSTABLE MULTI-POSITION BENCH AND MASSAGE PLATFORM

(71) Applicants: Martin Husslage, Rye, NH (US); Alexandra Darian Husslage, Rye, NH (US); Devin Connor Husslage, Rye, NH (US); Garret Staples Husslage, Rye, NH (US)

(72) Inventors: Martin Husslage, Rye, NH (US); Alexandra Darian Husslage, Rye, NH (US); Devin Connor Husslage, Rye, NH (US); Garret Staples Husslage, Rye, NH (US)

( * ) Notice: Subject to any disclaimer, the term of this patent is extended or adjusted under 35 U.S.C. 154(b) by 0 days.

(21) Appl. No.: 13/625,005

(22) Filed: Sep. 24, 2012

(65) Prior Publication Data

US 2014/0082835 A1 Mar. 27, 2014

Related U.S. Application Data

(60) Provisional application No. 61/538,803, filed on Sep. 24, 2011.

(51) Int. Cl.

| | |
|---|---|
| ***A47C 13/00*** | (2006.01) |
| ***A47C 17/04*** | (2006.01) |
| ***A61G 13/00*** | (2006.01) |
| *A61G 13/06* | (2006.01) |
| *A61G 13/08* | (2006.01) |

(52) U.S. Cl.

CPC ..... *A47C 13/00* (2013.01); *A47C 17/04* (2013.01); *A61G 13/009* (2013.01); *A61G 13/06* (2013.01); *A61G 13/08* (2013.01)

(58) Field of Classification Search

CPC ..... A61G 13/00–13/08; A47C 13/00; A47C 17/00; A47C 17/04

USPC ..... 5/2.1, 610, 11, 600, 611, 606, 671

See application file for complete search history.

(56) References Cited

U.S. PATENT DOCUMENTS

| | | | | |
|---|---|---|---|---|
| 8,015,638 | B2 * | 9/2011 | Shimada et al. | 5/611 |
| 8,104,120 | B2 * | 1/2012 | Hornbach et al. | 5/611 |
| 8,484,779 | B1 * | 7/2013 | Bradwell | 5/610 |
| 2008/0016616 | A1 * | 1/2008 | Roleder et al. | 5/2.1 |
| 2010/0257671 | A1 * | 10/2010 | Shimada et al. | 5/611 |
| 2013/0340167 | A1 * | 12/2013 | Karwal et al. | 5/611 |

* cited by examiner

*Primary Examiner* — Peter M Cuomo
*Assistant Examiner* — Brittany Wilson
(74) *Attorney, Agent, or Firm* — Kintner IP, LLC; Mary Frances Ludwig

(57) ABSTRACT

A bench with a height adjustable top assembly that functions both as a massage platform when in the raised position and a bench for seating when in the lowered position and is designed with the aesthetic characteristics of furniture that can be left in place when not in use as a massage platform. The massage platform is raised into position by lifting the ends of the massage platform top assembly. The manual power assist assembly provides assistance when raising the top assembly. When not in use as a massage platform the top assembly can be lowered to rest on the base assembly and can be used for seating. Further, a portion of the top assembly massage platform can be raised providing a back rest with multiple reclining positions.

11 Claims, 7 Drawing Sheets

HEIGHT ADJUSTABLE MULTI-POSITION BENCH AND MASSAGE PLATFORM

CROSS REFERENCE TO RELATED APPLICATIONS

The present application claims the filing benefit under 35 U.S.C. §119(e) of U.S. provisional patent application, Ser. No. 61/538,803, filed Sep. 24, 2011, for BENCH MASSAGE TABLE, by Martin Husslage, which is hereby incorporated by reference.

FIELD OF THE INVENTION

The present invention relates generally to massage tables, and specifically to a height adjustment mechanism for the massage platform and improved aesthetic appearance.

BACKGROUND OF THE INVENTION

Since the invention of the massage platform, a form providing a useful function both when being used for a massage and when not being utilized for the massage function, and further having the aesthetic appearance that is acceptable in most offices and homes has been desired. However, until now, massage platforms have been in a form that has been unusable for a seating function when not being utilized for the massage function. If the space occupied by the massage platform is to be used for another function, the user must store the platform in another location until required for a massage. Also, the current forms of massage platform do not fit aesthetically with most office and home decors, thus requiring the user to store the unit in another location until required for use when it must be retrieved. In addition, some require manual setup, adding time and complexity to the massage event.

Currently massage tables exist in collapsible table, single use platform, and kneeling forms.

The following prior art reflects the state of the art of which the applicant is aware and is included within to discharge the applicant's acknowledged duty to disclose relevant prior art. This is stipulated, however, that none of these references teach singly nor render obvious when considered in conceivable combination the nexus of the instant invention as disclosed in greater detail hereinafter and as particularly claimed.

| Pat. No. | Issue Date | Inventor |
|---|---|---|
| 5,676,062 | Oct. 14, 1997 | John T Lloyd |
| 7,036,437 | May 2, 2006 | Kwan Jun Choi, Kwang Ho Baik |
| 5,490,298 | Feb. 13, 1996 | Aaron Goldsmith, Craig Adams |
| 3,227,112 | Jan. 4, 1966 | Joseph Wiseman |
| 4,526,346 | Jul. 2, 1985 | James J. Galloway, Albert E. Blanchard |
| D555249 | Nov. 13, 2007 | Jon Roleder, Richard Estrada |
| 7,631,940 | Dec. 15, 2009 | Barbara K. Jager |
| 2,765,479 | Oct. 9, 1956 | John G. Sevcik |
| D552738 | Oct. 9, 2007 | Keith Helfet |

Portable Massage Tables

Portable massage tables are very useful for those requiring the unit be highly transportable. However, the form of the portable massage table is such that it is aesthetically incompatible in most office and home spaces and is typically stored in another location when not in use. Some collapsible massage tables provide some height adjustability allowing them to be adjusted to a comfortable height for the user. However, the height adjustment is too limited to allow them to be adjusted to a comfortable seating height.

Stationary Massage and Clinical Single Use Tables

Stationary massage and clinical single use tables are suitable in the spa and clinical environment where the space for a stationary table would not be allocated for any other function. Some stationary massage and clinical tables provide the ability to adjust the height for the comfort of the user. However, the height adjustment is limited to a vertical range insufficient to lower the top surface height to a comfortable seating position.

Electric Height Adjustability

A number of massage tables provide an electrically driven height adjustment mechanism. However, this mechanism can limit the placement of the unit as it must be connected to an electrical outlet for the height adjustment to function.

It is therefore an object of the invention to provide a manual configuration, multi-position, seating and massage platform with the aesthetic characteristics of furniture allowing it to be left in place when not in use for the massage function.

It is also an object of the invention to provide a manually operated mechanism that allows simple configuration of the riser top assembly from the lowered seating position to a raised massage platform position.

It is also an object of the invention to provide a mechanism that provides manual power assistance for transitioning the riser top assembly between the lowered seating position and a raised massage platform position.

It is also an object of the invention to provide a mechanism that automatically vertically aligns the riser top assembly to the base assembly when the riser top assembly is in both the lowered and raised positions above the base assembly, thereby providing maximum stability of the platform in all positions.

SUMMARY OF THE INVENTION

In accordance with the present invention, there is provided a bench with a height adjustable riser top assembly that functions both as a massage platform when in a raised position and a bench for seating when in a lowered position and is designed with the aesthetic characteristics of furniture that can be left in place when not in use as a massage platform.

The massage platform is raised into position by manually lifting each end of the riser top assembly. As the riser top assembly is being lifted, a support mechanism, which attaches the riser top assembly to a base assembly, pivots to a fully extended position and is locked in place for use as a massage platform. A manual power assist mechanism provides power assistance when raising the riser top assembly.

When not in use as a massage platform the riser top assembly can be lowered to rest on the base assembly and can be used for seating. When being lowered, the lower end of the support mechanism is guided by a slide guide assembly to a position such that the riser top assembly is in alignment with the base assembly.

Further, a portion of the riser top assembly massage platform can be rotated into multiple inclined positions, providing a back rest with multiple reclining positions. To raise the back rest assembly, lift the end of the back rest assembly and rotate it to the desired recline angle. Lower the back rest assembly slightly and the back rest incline adjustment mechanism will lock into position. To lower the back rest assembly, rotate the back rest assembly to a near perpendicular position to release the locking mechanism and then lower the back rest assembly to the desired recline angle or flat position.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DETAILED DESCRIPTION OF THE INVENTION

Figure 1A:
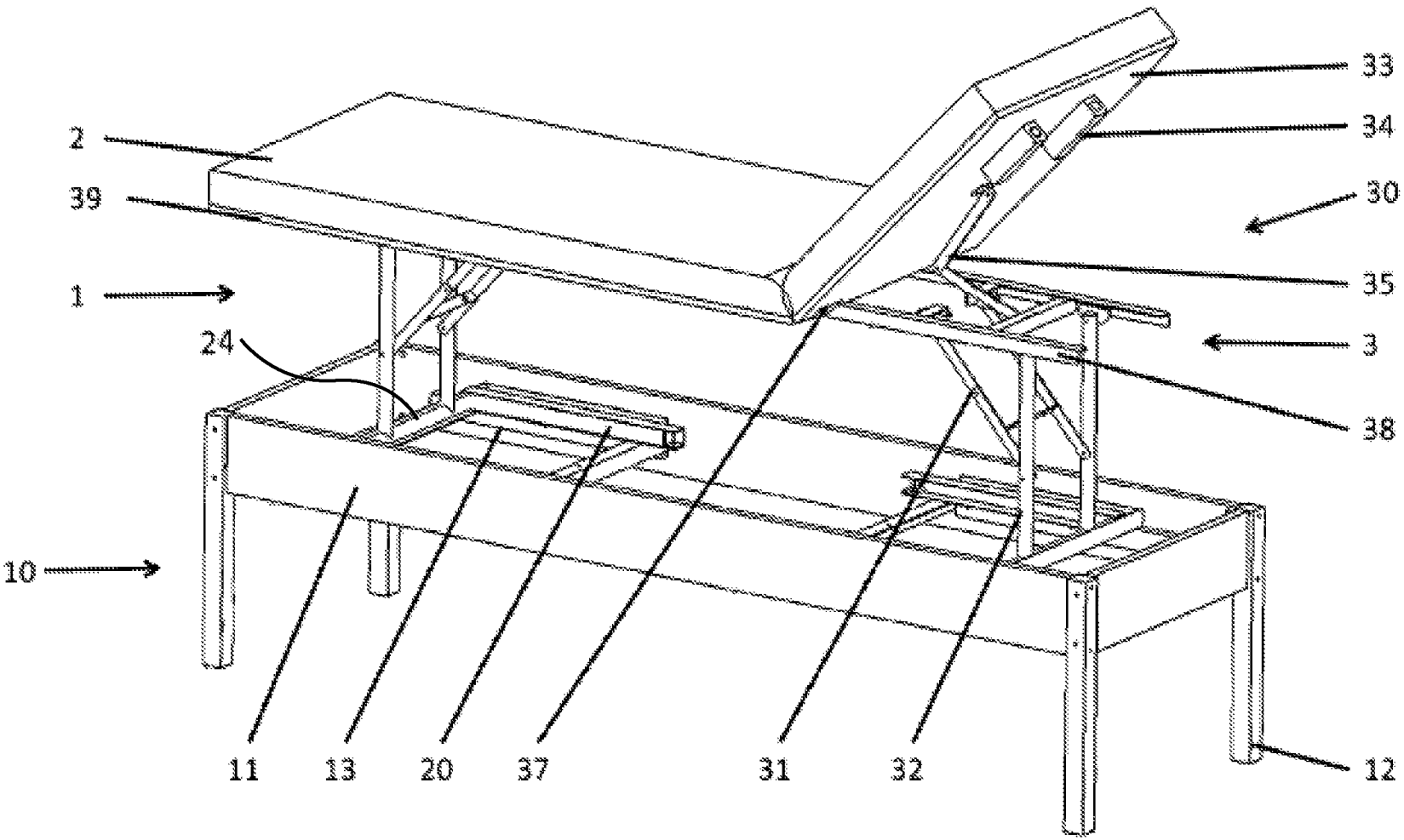
FIG. 1A is an isometric view of an embodiment of a height adjustable multi-position bench and massage platform with a riser top assembly in a raised position above a base assembly.

FIG. 1A shows an isometric view of one embodiment of the height adjustable multi-position bench and massage platform 1.

The base assembly 10 typically consists of a perimeter frame 11 creating an internal volume. In this embodiment I have contemplated that the perimeter frame be supported by a number of perimeter frame supports 12 of such a length that the top of the base assembly 10 is slightly lower than the average seating height. In the preferred embodiment the base assembly 10 is made of wood, however, other materials of sufficient strength, such as metal, can be used.

The riser base support bar 13 is connected to the internal volume side of the perimeter frame 11 in a number of locations.

Figure 2:
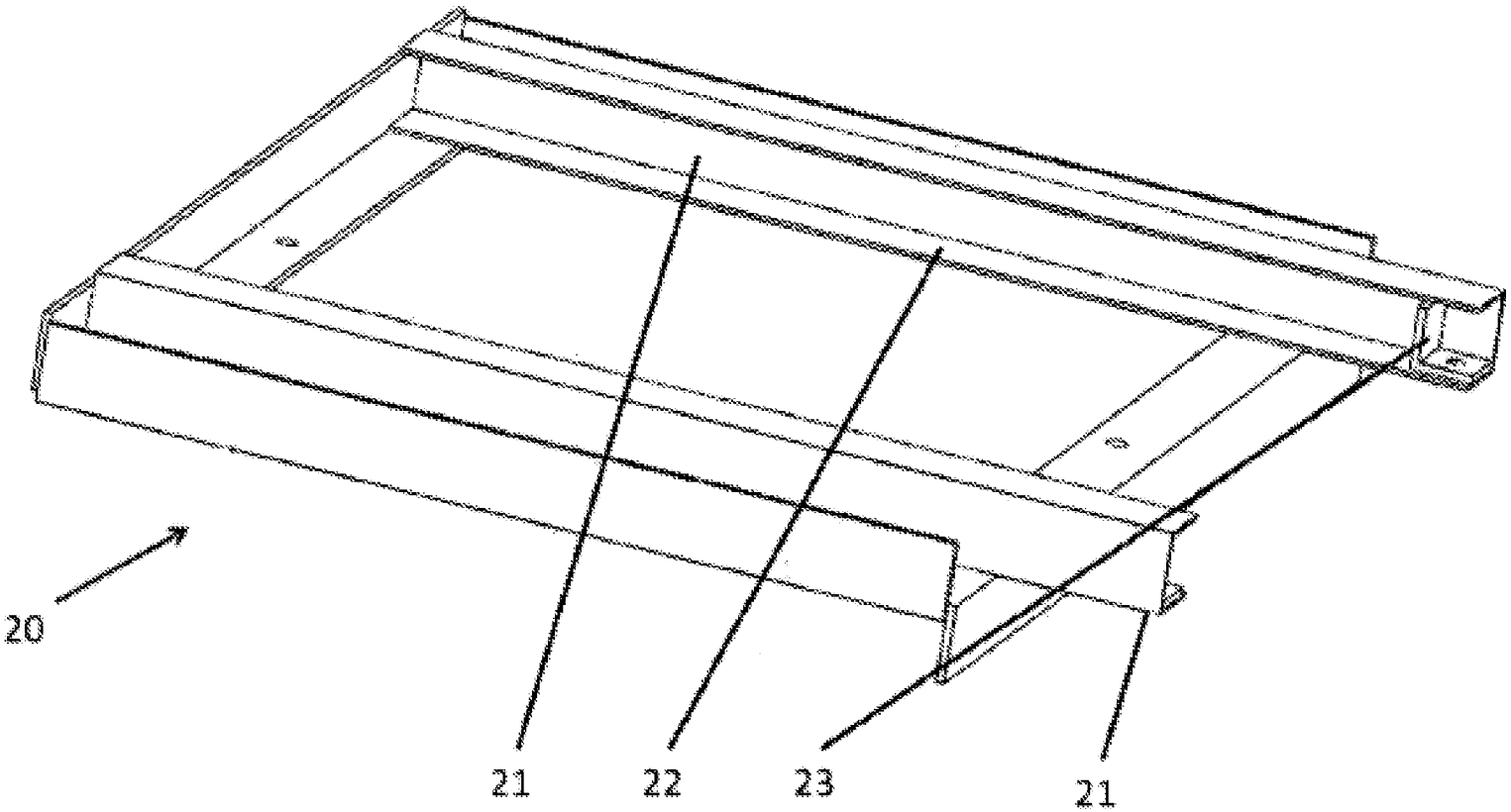
FIG. 2 is an isometric view of an embodiment of a riser base assembly.

Two riser base assemblies 20 are each attached to a riser base support bar 13 on either side of the perimeter frame 11 and are oriented such that the open ends of each riser base assembly slide guide 21, shown in FIG. 2, open toward each other.

With the riser top assembly 30 in the raised position, as shown in FIG. 1, the lower end 24 of the riser top assembly support mechanism 32 rests on the lower nylon strip 22 and between two riser base assembly slide guides 21 (see FIG. 2).

At the riser top assembly back rest end 3 the top of the riser top assembly support mechanism 32 is pivotally connected to the riser top assembly frame 38. The riser top assembly support locking mechanism 31 is pivotally attached to both the riser top assembly frame 38 and the riser top assembly support mechanism 32.

At the riser top assembly top board end 2 the top of the riser top assembly support mechanism 32 is pivotally connected to the riser top assembly frame 38. The riser top assembly support locking mechanism 31 is pivotally attached to both the riser top assembly top board 39 and the riser top assembly support mechanism 32.

The riser top assembly top board 39 is attached to the riser top assembly frame 38. The riser top assembly back rest 33 is pivotally attached to the riser top assembly top board 39 via hinges 37 located on both sides of the riser top assembly frame 38 (see FIG. 1B for alternate position of riser top assembly back rest 33).

The back rest incline adjustment mechanism 35 is pivotally attached to the riser top assembly frame 38 and the riser top assembly back rest 33.

The head rest attach block 34 is attached in multiple locations to both the riser top assembly top board 39 and the riser top assembly back rest 33.

FIG. 2 shows an isometric view of one embodiment of the riser base assembly 20.

In this embodiment, the riser base assembly slide guide 21 is a U shaped channel made of metal with a lower nylon strip 22 adhered to the opposite inner sides of the U shaped channel. However, the riser base assembly slide guide 21 can be made from other materials with sufficient strength, such as fiberglass, and other low friction materials, such as plastic, can be applied to the sides of the riser base assembly slide guide 21.

A riser base assembly slide guide lower position stop 23 is attached to the open end of each riser base assembly slide guide 21.

Figure 3:
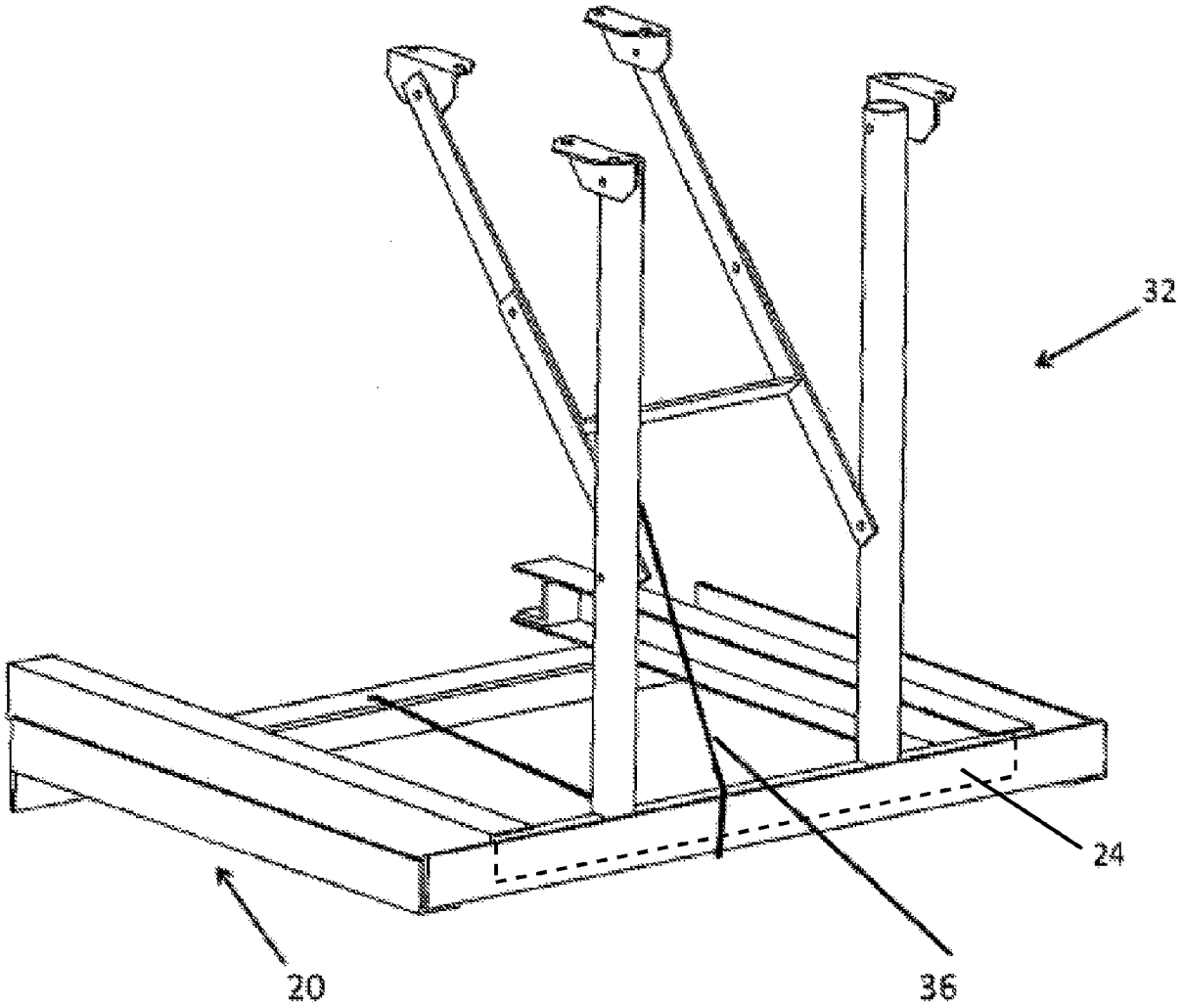
FIG. 3 is an isometric view of an enlarged segment of the riser top assembly showing an embodiment of a riser top assembly manual power assist mechanism.

FIG. 3 shows an isometric view of one embodiment of the riser top assembly manual power assist mechanism 36.

This embodiment of the riser top assembly manual power assist mechanism 36 shows a bungee cord attached to both the riser base assembly 20 and the riser top assembly support locking mechanism 31. (Attachment at the riser top assembly support locking mechanism 31 is hidden in FIG. 3.) However, the riser top assembly manual power assist mechanism 36 can be made from other materials with sufficient strength, such metal springs.

Detailed Description of the Operation of this Embodiment

With the riser top assembly 30 and the riser top assembly back rest 33 in their lowered positions the riser top assembly top board 39 and the riser top assembly back rest 33 rest on top of the base assembly 10.

Figure 1B:
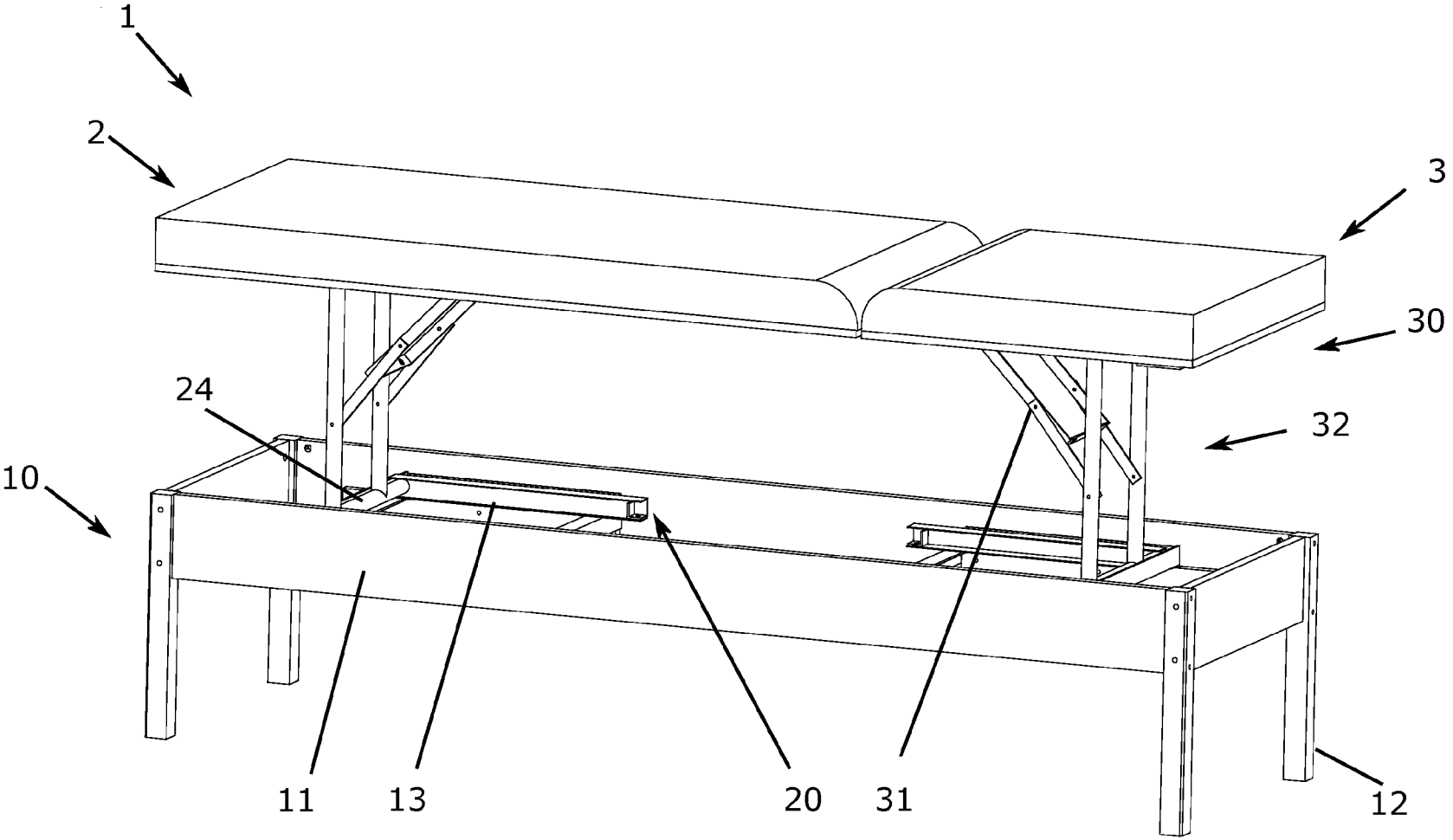
FIG. 1B is an isometric view of the embodiment in an alternate position.

The riser top assembly back rest 33 can be rotated into an inclined position by rotating the end of the riser top assembly back rest 33 to the desired position and releasing it, thereby locking it into that position (see FIGS. 1A and 1B). The riser top assembly back rest 33 can be lowered from an inclined position by rotating the riser top assembly back rest 33 to a nearly vertical position and then lowering it to the next desired inclined position.

The riser top assembly 30 can be raised to a massage platform position above the base assembly 10 by lifting the riser top assembly top board 39 at the riser top assembly top board end 2 to the fully raised position and engaging the riser top assembly support locking mechanism 31. The riser top assembly back rest end 3 of the riser top assembly 30 is then raised to the fully raised position and the riser top assembly support locking mechanism 31 is engaged.

Figure 4:
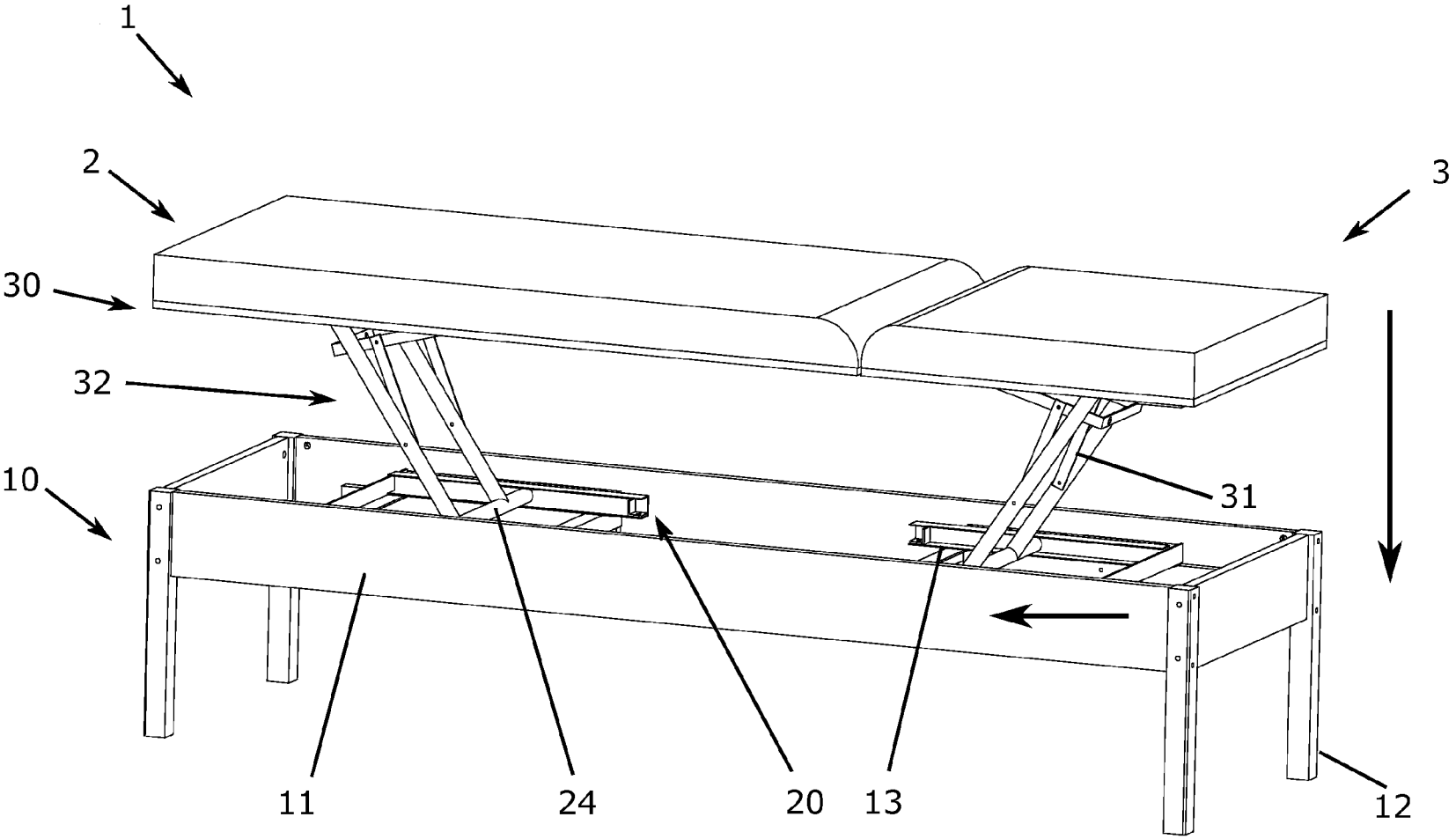
FIG. 4 is an isometric view of the height adjustable multi-position bench and massage platform moving between the raised position and a lowered position; and, FIGS. 5A and 5B are side elevation views of the embodiments of FIGS. 1A and 1B, respectively.

FIG. 4 is an isometric view of the height adjustable multi-position bench and massage platform moving between the raised position and lowered positions. Arrows indicate vertical positioning of the riser top assembly 30 and horizontal positioning of the lower end 24 of riser top assembly support mechanism 32.

In operation the riser top assembly top board 39 is lifted at one of the narrow ends (2 or 3) of the base assembly 10. As the riser top assembly top board 39 is being lifted the riser leg assembly horizontal bottom bar (lower end 24) is guided in-between the riser base assembly slide guides 21 such that the riser leg assembly horizontal bottom bar (lower end 24) slides from the center region of the base assembly 10 horizontally toward the end of the base assembly 10 from which the riser top assembly top board 39 is being lifted. The same procedure is repeated at the opposite end of the riser top assembly top board 39 to bring the riser top assembly top board 39 into the raised position.

The riser top assembly 30 can be lowered to the seating position by disengaging the riser top assembly support locking mechanism 31 at the riser top assembly top board end 2 and lowering the riser top assembly top board 39 to rest on the base assembly 10 and then disengaging riser top assembly support locking mechanism 31 at the riser top assembly back rest end 3 and lowering the riser top assembly 30 to rest on the base assembly 10.

Alternative Embodiments

There are various possible embodiments with regard to the riser base assembly slide guide 21 mechanism which, for example, could include a number of recessed pockets along the lower side of the riser base assembly slide guide 21 enabling multiple height positions of the riser top assembly 30 above the base assembly 10 while maintaining vertical alignment between the base assembly 10 and the riser top assembly 30.

Figure 5A:
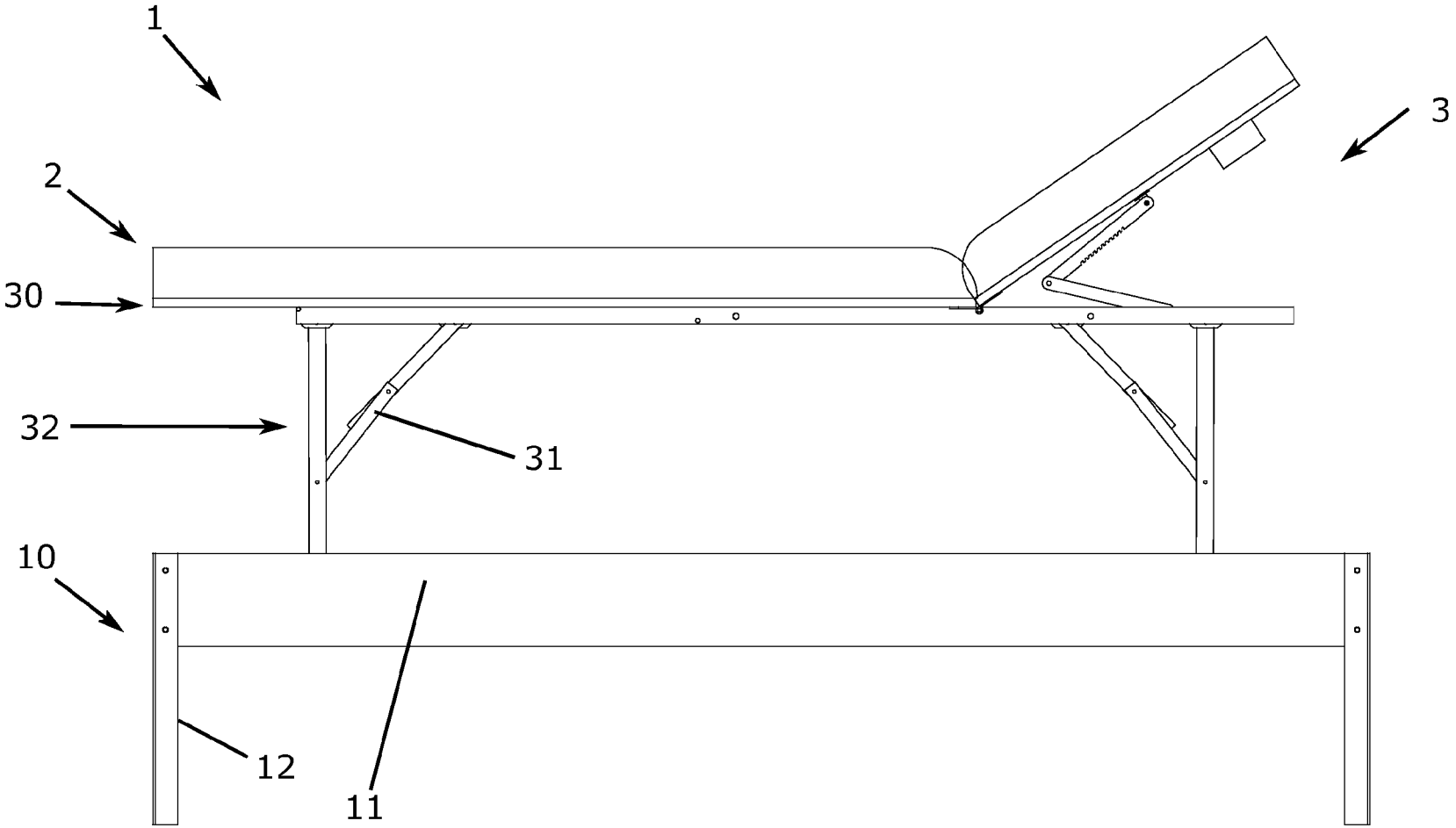
Figure 5B:
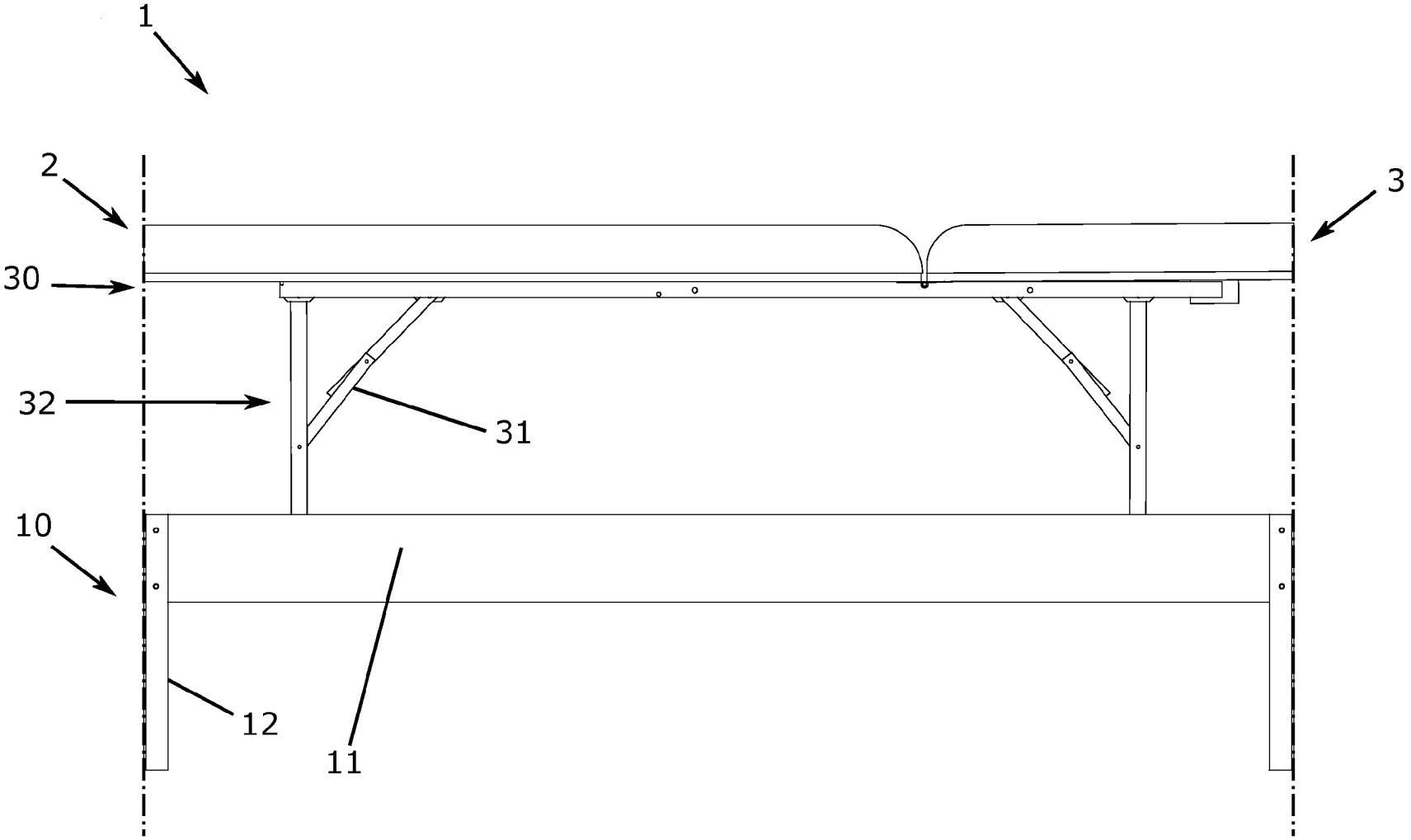

FIGS. 5A and 5B are side elevation views of the embodiments of FIGS. 1A and 1B, respectively. Phantom lines are used to indicate the vertical alignment between the base assembly 10 and the riser top assembly 30.

There are various possible embodiments with regard to the riser top assembly support mechanism 32 which, for example, could be comprised of an electronic or hydraulic mechanism for elevating the riser top assembly 30 to a height suitable for the massage platform.

There are various possible embodiments with regard to the riser top assembly top board 39 which, for example, could include the ability for a portion of the riser top assembly top board 39 to be elevated above the riser top assembly frame 38 to provide an inclined seating area.

Advantages

From the description above, a number of advantages of some of the embodiments of the height adjustable multi-position bench and massage platform become evident:

a) the riser top assembly 30 is vertically aligned to the base assembly 10 when the riser top assembly 30 is in the lower seating and elevated massage platform positions providing the maximum stability of the platform;

b) provides a mechanism that allows simple configuration of the riser top assembly 30 between the seating and massage platform positions;

c) provides manual power assistance for transitioning the riser top assembly 30 between the seated position and the massage platform positions; and, d) provides a manual configuration, multi-position, seating and massage platform with the aesthetic characteristics of furniture, allowing it to be left in place when not in use for the massage function.

Thus the reader will see that at least one embodiment of the height adjustable multi-position bench and massage platform 1 provides additional seating and a massage platform that is easily configurable, requires no electricity to operate, and is in a form that is aesthetically compatible with most home and office decors.

While the above description contains many specificities, these should not be construed as limitations on the scope, but rather as an exemplification of one proffered embodiment thereof. Many other variations are possible.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A height adjustable multi-position bench and massage platform comprising:

a riser top assembly vertically positionable into a raised position and a lowered position, said riser top assembly having a riser top assembly frame;

a base assembly;

a riser base assembly connected to said base assembly, said riser base assembly having a plurality of riser base assembly slide guides;

said riser base assembly slide guides being substantially horizontal and channel-shaped;

two riser top assembly support mechanisms, each having a top end and lower end, each of said lower ends tangentially connected with said riser base assembly and slidably positionable within at least one of said riser base assembly slide guides, and each of said top ends pivotally connected with said riser top assembly frame;

when said riser top assembly is vertically positioned into said raised position, said riser base assembly slide guides horizontally guiding said lower ends of said riser top assembly support mechanisms while maintaining vertical alignment of said riser top assembly with said base assembly, said riser top assembly providing a configurable multi-position massage platform;

means for providing vertical alignment of said riser top assembly with said base assembly when said riser top assembly is in said lowered position, rigidly connected to at least one of said riser base assembly slide guides;

when said riser top assembly is vertically positioned into said lowered position, said riser base assembly slide guides horizontally guiding said lower ends of said riser top assembly support mechanisms while maintaining vertical alignment of said riser top assembly with said base assembly, said riser top assembly providing a configurable multi-position seating area;

each of said riser top assembly support mechanisms having a manual power assist mechanism; and, said riser top assembly being biased to said raised position by said manual power assist mechanisms, so that when said riser top assembly is positioned from said lowered position to said raised position, said manual power assist mechanisms urge said riser top assembly toward said raised position.

2. The height adjustable multi-position bench and massage platform in accordance with claim 1, wherein each of said riser base assembly slide guides has a riser base assembly slide guide lower position stop.

3. The height adjustable multi-position bench and massage platform in accordance with claim 1, wherein each of said riser top assembly support mechanisms has a riser top assembly support locking mechanism, for locking said riser top assembly support mechanisms in place when said riser top assembly is in said raised position.

4. The height adjustable multi-position bench and massage platform in accordance with claim 1, wherein said lower ends of said riser top assembly support mechanisms move toward each other when said riser top assembly is positioned into said lowered position.

5. The height adjustable multi-position bench and massage platform in accordance with claim 4, wherein each said lower end of said riser top assembly support mechanisms is slidably positionable within two opposing said riser base assembly slide guides.

6. The height adjustable multi-position bench and massage platform in accordance with claim 1, wherein:

each of said riser top assembly support mechanisms has a load-bearing member; and, said load-bearing members are in a substantially vertical orientation when said riser top assembly is in said raised position.

7. The height adjustable multi-position bench and massage platform in accordance with claim 6, wherein said load-bearing members are in a substantially horizontal orientation when said riser top assembly is in said lowered position.

8. The height adjustable multi-position bench and massage platform in accordance with claim 1, wherein said manual power assist mechanisms are unitary elastic members.

9. The height adjustable multi-position bench and massage platform in accordance with claim 1, wherein said riser top assembly has a top board and a back rest, said back rest positionable at an upward incline with respect to said top board.

10. The height adjustable multi-position bench and massage platform in accordance with claim 9, wherein said riser top assembly has a back rest incline adjustment mechanism pivotally attached to said back rest and said riser top assembly frame.

11. The height adjustable multi-position bench and massage platform in accordance with claim 1, wherein:

each of said riser base assembly slide guides has a riser base assembly slide guide lower position stop located at one end thereof;

each of said riser top assembly support mechanisms has a riser top assembly support locking mechanism, for locking said riser top assembly support mechanisms in place when said riser top assembly is in said raised position;

said lower ends of said riser top assembly support mechanisms move toward each other when said riser top assembly is positioned into said lowered position;

each said lower end of said riser top assembly support mechanisms is slidably positionable within two opposing said riser base assembly slide guides;

each of said riser top assembly support mechanisms has a load-bearing member;

said load-bearing members are in a substantially vertical orientation when said riser top assembly is in said raised position;

said load-bearing members are in a substantially horizontal orientation when said riser top assembly is in said lowered position;

said manual power assist mechanisms are unitary elastic members;

said riser top assembly has a top board and a back rest, said back rest positionable at an upward incline with respect to said top board; and, said riser top assembly has a back rest incline adjustment mechanism pivotally attached to said back rest and said riser top assembly frame.

* * * * *